US008709695B2

(12) United States Patent
Nakamura

(10) Patent No.: US 8,709,695 B2
(45) Date of Patent: Apr. 29, 2014

(54) CARRIER FOR DEVELOPING ELECTROSTATIC CHARGE IMAGE, DEVELOPER FOR DEVELOPING ELECTROSTATIC CHARGE IMAGE, IMAGE FORMING APPARATUS, AND IMAGE FORMING METHOD

(75) Inventor: Yasushige Nakamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/554,543

(22) Filed: Jul. 20, 2012

(65) Prior Publication Data

US 2013/0252168 A1 Sep. 26, 2013

(30) Foreign Application Priority Data

Mar. 22, 2012 (JP) ..... 2012-065708

(51) Int. Cl.
*G03G 9/00* (2006.01)

(52) U.S. Cl.
USPC ..... 430/111.35; 430/111.3; 430/111.31

(58) Field of Classification Search
USPC ..... 430/111.1, 111.3, 111.31, 111.35, 430/111.4, 124.1
See application file for complete search history.

(56) References Cited

U.S. PATENT DOCUMENTS

| | | | | |
|---|---|---|---|---|
| 4,945,022 | A * | 7/1990 | Nakayama et al. | 430/123.58 |
| 6,416,864 | B1 * | 7/2002 | Hayashi et al. | 428/403 |
| 8,163,450 | B2 | 4/2012 | Kishida | |
| 2002/0192584 | A1 | 12/2002 | Hayashi et al. | |
| 2006/0051695 | A1 | 3/2006 | Yuasa et al. | |
| 2006/0269863 | A1 | 11/2006 | Nakamura et al. | |
| 2012/0028183 | A1 * | 2/2012 | Nakajima et al. | 430/124.1 |

FOREIGN PATENT DOCUMENTS

| | | |
|---|---|---|
| EP | 1 199 607 B1 | 4/2006 |
| JP | A-2003-280286 | 10/2003 |
| JP | A-2004-61730 | 2/2004 |
| JP | A-2004-361887 | 12/2004 |
| JP | A-2006-301537 | 11/2006 |
| JP | A-2006-330277 | 12/2006 |
| JP | A-2007-292854 | 11/2007 |
| JP | A-2009-9000 | 1/2009 |
| WO | WO 2004/031865 A1 | 4/2004 |

OTHER PUBLICATIONS

Jan. 30, 2013 Office Action issued in Australian Patent Application No. 2012/216697.

* cited by examiner

*Primary Examiner* — Stewart Fraser
(74) *Attorney, Agent, or Firm* — Oliff PLC

(57) ABSTRACT

A carrier for developing an electrostatic charge image includes a core containing a magnetic material and a coating layer, in which the coating layer includes porous carbon having a volume average particle size of from 0.5 μm to 2 μm and a BET specific surface area of from 1 $m^2/g$ to 5 $m^2/g$, and a resin.

15 Claims, 3 Drawing Sheets

CARRIER FOR DEVELOPING ELECTROSTATIC CHARGE IMAGE, DEVELOPER FOR DEVELOPING ELECTROSTATIC CHARGE IMAGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2012-065708 filed Mar. 22, 2012.

BACKGROUND

1. Technical Field

The present invention relates to a carrier for developing an electrostatic charge image, a developer for developing an electrostatic charge image, an image forming apparatus, and image forming method.

2. Related Art

A two-component developer which is used for electrophotography is generally formed of carrier particles having magnetic properties and toner particles having insulation properties.

SUMMARY

According to an aspect of the invention, there is provided a carrier for developing an electrostatic charge image including a core containing a magnetic material and a coating layer, wherein the coating layer contains porous carbon having a volume average particle size of from 0.5 μm to 2 μm and a BET specific surface area is from 1 $m^2/g$ to 5 $m^2/g$, and a resin.

BRIEF DESCRIPTION OF THE DRAWINGS

Exemplary embodiments of the present invention will be described in detail based on the following figures, wherein.

DETAILED DESCRIPTION

Hereinafter, a carrier for developing an electrostatic charge image, a developer for developing an electrostatic charge image, and an image forming apparatus according to an exemplary embodiment of the invention will be described in detail.

Carrier for Developing Electrostatic Charge Image

The carrier for developing an electrostatic charge image according to the exemplary embodiment (hereinafter, sometimes referred to as the carrier according to the exemplary embodiment) includes a core containing a magnetic material and a coating layer which coats the surface of the core. In this case, the coating layer includes porous carbon having a volume average particle size of from 0.5 μm to 2 μm and a BET specific surface area of from 1 $m^2/g$ to 5 $m^2/g$ (hereinafter, sometimes referred to as the specific porous carbon), and a resin.

Figure 1:
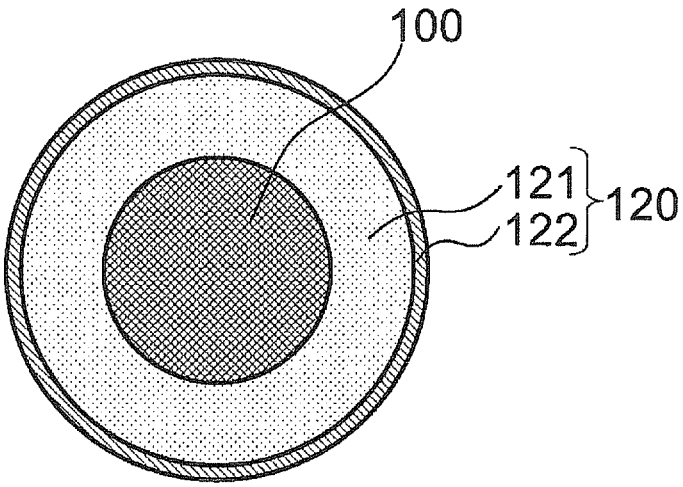
FIG. 1 is a cross-sectional view schematically illustrating an example of a carrier for developing an electrostatic charge image according to an exemplary embodiment of the invention.

FIG. 1 is a cross-sectional view schematically illustrating an example of the carrier according to the exemplary embodiment. The carrier according to the exemplary embodiment includes a core 100 containing a magnetic material and a coating layer 120. The coating layer 120 includes a resin (not shown) and the specific porous carbon (not shown).

In a carrier according to a first embodiment shown in FIG. 1, the coating layer 120 with which the core 100 is coated, is composed of two layers of a first coating layer 121 and a second coating layer 122. However, the coating layer may be composed of a single layer or three or more layers.

An electrostatic charge image on a photoreceptor (latent image holding member) is developed by a toner. At this time, while the carrier and the toner are agitated in a developing device, only the toner is consumed and the carrier is repeatedly used. Due to this agitation, electric charge is applied to the toner from the carrier, the charged toner is transferred on the side of the photoreceptor, and a toner image is formed on the surface of the photoreceptor. However, due to external stress caused by this agitation, the surface of the carrier is peeled off (worn away) and thus the carrier deteriorates. The deterioration of the carrier becomes more significant with increasing processing speed.

In this case, when images having a low coverage rate are continuously formed, a toner is rarely replaced and thus the friction between carrier particles increases. Accordingly, the electrical resistance of the carrier increases and image density is easily reduced, for example, an image is blurred. In particular, in a developing device of a continuous feed printing system in which the processing speed exceeds 1000 mm/sec, unlike a carrier of a low-speed printing system, it is necessary that development be performed instantaneously and the electrical resistance of a carrier coating material be designated to be lower than that of the core, in order to obtain sufficient image density. Since images are continuously formed for 2 hours on a roll of continuous paper, which corresponds to 120000 sheets of A4-size paper, the load on the developer is significantly large. Furthermore, when images having a high coverage rate are formed immediately after 120000 images having a low coverage rate are formed, the followability of the toner for image density further deteriorates and thus image density may change.

To address this problem, in a cut paper printer, a developing device including a replenishing device may be provided. When the amount of a replenishing developer, which is predicted by a replenishing amount prediction unit provided in the replenishing device, is smaller than a predetermined amount, a toner in the developing device is compulsorily supplied to a latent image holding member to be consumed and a replenishing developer is compulsorily supplied from the replenishing device to the developing device. As a result, a toner and a carrier are compulsorily replaced with new ones and thus the change of image density is suppressed.

However, in this method, it is extremely difficult to control the waste amount and the supply amount of a developer, and excessive amounts of developer including a toner having image forming capability are wasted. Therefore, it is desirable to reduce the waste amount also from an environmental viewpoint. In addition, since the running cost is significantly increased, it is practically difficult to apply this method to an ultrahigh-speed printing system which is used in the printing industry. Furthermore, there is a large problem in that, when images are formed on continuous paper, there is no interval for replacing toner and thus it is difficult to put a waste process into an image forming process during image formation.

In addition, an external additive for a toner may be used in order to address a problem that image density deteriorates when images having a low coverage rate are continuously formed. However, in a high-speed printer and the like in which the print speed exceeds 1000 mm/sec, the load on the toner is large and thus the change of the external additive such as desorption or deformation is unavoidable. Therefore, the external additive is less effective for the problem.

In consideration of the above-described circumstances, there is required a carrier in which stable image density is obtained even when images having a low coverage rate are printed in a high-speed printing system.

In the carrier according to the exemplary embodiment, the coating layer 120 contains a resin and the specific porous carbon. As a result, even when images having a low coverage rate of 1% or lower are printed at a print speed of 1000 mm/sec or higher, the change of optical density is suppressed. The reason for this phenomenon is not clarified but presumed as follows.

It is presumed that, when the specific porous carbon is added to the coating layer containing a resin, the resin and the specific porous carbon act as a cushion, the friction between carrier particles or between carrier particles and a magnet roll is relieved, and the change of electrical resistance is suppressed. As a result, it is considered that, when images having a low coverage rate of 1% or lower are printed at a low print speed of 1000 mm/sec or higher, the change of the electrical resistance of a carrier is suppressed and the change of optical density is suppressed.

Hereinafter, the respective configurations of the carrier according to the exemplary embodiment will be described in detail.

Core

The core 100 which is used in the exemplary embodiment is not particularly limited, and examples thereof include a magnetic metal such as iron, steel, nickel, or cobalt, a magnetic oxide such as ferrite or magnetite, and a magnetic particle-dispersed core containing magnetic particles and a binder resin.

In addition, as an example of ferrite, ferrite having a structure represented by Formula (I) below is preferable.

$$(MO)_X(Fe_2O_3)_Y \quad (1)$$

In Formula (I), M represents at least one kind selected from a group consisting of Cu, Zn, Fe, Mg, Mn, Ca, Li, Ti, Ni, Sn, Sr, Al, Ba, Co, and Mo. In addition, X and Y represents mole ratios and satisfy the condition of X+Y=100.

Among these, ferrite has a magnetic force lower than that of magnetite and a low stress for a magnetic brush, which is preferable from the viewpoint of prolonging service life thereof.

The magnetic particle-dispersed core is obtained by dispersing magnetic particles in a binder resin.

As the magnetic particles, any magnetic particles which are well-known in the related art may be used. However, preferably, ferrite, magnetite, or maghematite particles are used. In particular, as ferromagnetic particles, magnetite or maghematite particles are used. As other magnetic particles, for example, iron powder is known.

Specific examples of magnetic particles constituting the magnetic particle-dispersed core include iron oxides such as magnetite, γ-ferric oxide, Mn—Zn ferrite, Ni—Zn ferrite, Mn—Mg ferrite, Li ferrite, and Cu—Zn ferrite. Among these, magnetite is more preferable.

Examples of the binder resin constituting the magnetic particle-dispersed core include cross-linked styrene resin, acrylic resin, styrene-acrylic copolymer resin, and phenol resin. Among these, phenol resin is particularly preferable.

In addition, depending on purpose, the magnetic particle-dispersed core according to the exemplary embodiment may contain other components. As other components, for example, a charge-controlling agent, fluorine-containing particles and the like may be used.

The particle size of the core 100 is preferably from 10 μm to 150 μm, more preferably from 15 μm to 100 μm, and still more preferably from 20 μm to 40 μm.

Coating Layer

The coating layer 120 contains at least a resin and the specific porous carbon.

Porous Carbon

In porous carbon which is used in the exemplary embodiment, the volume average particle size is from 0.5 μm to 2 μm and the BET specific surface ratio is from 1 $m^2/g$ to 5 $m^2/g$.

When the volume average particle size of porous carbon is equal to or larger than 0.5 μm, cushioning characteristics of the coating layer, which is derived from porous carbon, are improved. When the volume average particle size of porous carbon is smaller than or equal to 2 μm, the size of porous carbon is not excessively large and porous carbon may be incorporated into the coating layer without protruding out. It is more preferable that the volume average particle size of porous carbon is from 1 μm to 2 μm.

The volume average particle size of porous carbon is measured using the following method.

Dispersion of porous carbon particles is prepared using polyvinyl alcohol. The volume average particle size is measured using a laser diffraction/scattering particle size distribution analyzer (manufactured by HORIBA, Ltd., LA-920: the lower limit of detection value is 0.02 μm). In order to measure particle sizes in a state where the particle association in the dispersion medium is separated to the extent possible, the dispersion is mixed for 10 minutes using a blender having a rotating speed of 1500 rpm or higher to prepare uniform suspension. Next, a water dispersion sample obtained by treating this suspension with ultrasonic waves for 3 minutes is supplied to a cell of the particle size distribution analyzer and treated again with ultrasonic waves (for 3 minutes). Then, particle size distribution is measured.

When the BET specific surface area of porous carbon is equal to or greater than 1 $m^2/g$, cushioning characteristics are obtained sufficiently. When the BET specific surface area of porous carbon is less than or equal to 5 $m^2/g$, porous carbon particles may be uniformly dispersed in a carrier coating resin. It is more preferable that the BET specific surface area of porous carbon be from 2 $m^2/g$ to 4 $m^2/g$.

The BET specific surface area of porous carbon is measured by the following method.

The BET specific surface area of porous carbon is measured using multipoint BET method in which an automated gas sorption analyzer (AUTOSORB, manufactured by Yuasa Ionics Co., Ltd.) is used and nitrogen gas is used as adsorption gas. As the pretreatment of a sample, deaeration is performed for 10 hours at 50° C.

The preparation method of porous carbon is not particularly limited, and, for example, the following preparation method is used.

First, a burned plant material is prepared by burning and carbonizing any one of soybean hull, rapeseed meal, cottonseed hull, and sesame meal.

The burned plant material is obtained by burning soybean hull or the like at a temperature of, for example, 900° C. in an atmosphere of inert gas such as nitrogen gas or in a vacuum using a carbonization plant such as a holding furnace or a rotary kiln. The burned material of soybean hull or the like is pulverized and screened using, for example, a mesh with a size of 106 square μm. By doing this, approximately 80% of the entire burned material of soybean hull or the like may have particle sizes of 85 μm or less. In this case, the median particle size is from 30 μm to 60 μm, for example.

As porous carbon, commercially available products may be used. As the commercially available products, RB Ceramics (RBC powder of 10 μm or less, manufactured by Sanwa Yushi Co., Ltd.), PHYTOPOROUS SH-3030, SH-0930, and SH-0905 (manufactured by The Nisshin OilliO Group, Ltd.) are known and available in general. These porous carbons may be used alone or in combination with two or more kinds thereof.

However, when the particle sizes are large, porous carbon particles may be pulverized using a jet mill and the rotating speed of a separator may be changed to obtain porous carbon with a desired particle size.

Resin

The resin used for the coating layer 120 is not particularly limited, and examples thereof include fluororesin, acrylic resin, epoxy resin, polyester resin, fluoro-acrylic resin, acrylic styrene resin, silicone resin, modified silicone resin (which is modified with acrylic resin, polyester resin, epoxy resin, alkyd resin, urethane resin or the like), and cross-linked fluorine-modified silicone resin. Vinylidene fluoride-containing resin such as a vinylidene fluoride-tetrafluoroethylene copolymer and fluorine-modified silicone resin are preferable and vinylidene fluoride-containing resin is more preferable, from the viewpoint of low critical surface tension.

Other Components

Optionally, a conductive material, a charge-controlling agent, a resistance control agent, and the like may be added to the coating layer 120.

Specific examples of the conductive material include a metal such as gold, silver, or copper; Carbon Black; a single conductive metallic oxide such as titanium oxide or zinc oxide; and a composite in which the surfaces of particles of titanium oxide, zinc oxide, aluminum borate, potassium titanate, tin oxide, indium oxide tin, or the like are coated with a conductive metal oxide.

Carbon Black is particularly preferable from the viewpoints of preparation stability, cost, and low electrical resistance. The kind of Carbon Black is not particularly limited, but Carbon Black having a dibutylphthalate (DBP) oil absorption of 50 ml/100 g to 300 ml/100 g is preferable due to its excellent preparation stability. The average particle size of conductive particles is preferably less than or equal to 0.1 μm and the primary particle size thereof is preferably less than or equal to 50 nm in consideration of dispersion in a resin. In addition, the specific surface area thereof is preferably equal to or greater than 700 $m^2/g$, from the viewpoints of high conductivity and that electrical resistance is reduced sufficiently with less amount of addition. As Carbon Black which satisfies these conditions, Ketjen Black (manufactured by Lion Corporation) is more preferable.

Layer Configuration

Such a coating layer may be a single layer or multiple layers of two or more layers. The single layer is preferable because the preparation process is simple. In addition, in the case of multiple layers, the first coating layer 121 which is provided on the side of the core contains a conductive material such that the content of the conductive material in the first coating layer 121 is greater than that in the second coating layer 122 which is provided as the outermost layer. As a result, the conductive material is prevented from being desorbed from the coating layer. Furthermore, by increasing the content of the specific porous carbon in the second coating layer which is provided as the outermost layer, abrasion resistance is improved and therefore lifetime is increased.

When the coating layer is a single layer, it is preferable that the coating amount be from 0.05% by weight to 10% by weight with respect to the carrier core. When the coating amount is equal to or greater than 0.05% by weight, the coating layer has a uniform thickness, and when the coating amount is less than or equal to 10% by weight, the aggregation of carrier particles is suppressed, thereby suppressing yield deterioration.

When the coating layer is a single layer, the content of porous carbon in the coating layer is preferably from 0.04 part by weight to 5 parts by weight and more preferably from 0.2 part by weight to 2 parts by weight, with respect to 100 parts by weight of the core. When the content of porous carbon is equal to or greater than 0.04 part by weight with respect to 100 parts by weight of the core, there is an advantageous effect for cushioning characteristics. When the content of porous carbon is less than or equal to 5 parts by weight with respect to 100 parts by weight of the core, porous carbon is uniformly dispersed in the coating resin and thus the amount of porous carbon desorbed therefrom may be reduced.

When the coating layer is a single layer, the content of the conductive material in the coating layer is preferably from 0 parts by weight to 10 parts by weight and more preferably from 0.2 part by weight to 1 part by weight, with respect to 100 parts by weight of the core. When the coating layer contains the conductive material, high optical density is achieved. When the content of the conductive material is less than or equal to 10 parts by weight with respect to 100 parts by weight of the core, fog is improved.

In addition, when the coating layer is multiple layers, the coating amount of the first coating layer 121 which is provided on the side of the core is preferably from 0.05% by weight to 10% by weight with respect to the carrier core. When the coating amount is equal to or greater than 0.05% by weight, the coating layer has a uniform thickness, and when the coating amount is less than or equal to 10% by weight, the aggregation of carrier particles is suppressed, thereby suppressing yield deterioration.

In addition, the coating amount of the second or subsequent coating layer is not limited as long as it supplements the coating of the first coating layer, and thus may be less than that of the first coating layer.

When the coating layer is multiple layers, the content of the conductive material in the first coating layer 121 which is provided on the side of the core is preferably from 0 parts by weight to 10 parts by weight and more preferably from 0.2 part by weight to 1 part by weight, with respect to 100 parts by weight of the core. When the coating layer contains the conductive material, high optical density is achieved. When the content of the conductive material is less than or equal to 10 parts by weight with respect to 100 parts by weight of the core, there is an advantageous effect for fog resistance.

When the coating layer is multiple layers, the content of porous carbon in the second coating layer 122 which is provided as the outermost layer is preferably from 0.04 part weight to 5 parts by weight and more preferably from 0.2 part by weight to 2 parts by weight with respect to 100 parts by weight of the core. When the content of porous carbon is equal to or greater than 0.04 part by weight with respect to 100 parts by weight of the core, there is an advantageous effect for cushioning characteristics. When the content of porous carbon is less than or equal to 5 parts by weight with respect to 100 parts by weight of the core, there is an advantageous effect for peeling resistance.

Preparation Method of Carrier

The preparation method of the carrier according to the exemplary embodiment is not particularly limited as long as the carrier having the above-described configuration can be formed in this method. Hereinafter, an example of the preparation method of the carrier according to the exemplary embodiment will be described.

The resin-coated carrier is prepared using various methods such as a spray method of spraying, for example, a resin-coated-layer-forming solution, which is obtained by stirring and dispersing a solution in which a coating resin is dissolved using a stirring device (for example, a sand mill), on the surface of the carrier core; and a kneader coater method of mixing the resin-coated-layer-forming solution and the carrier core in a kneader coater and removing a solvent.

The preparation method of the resin-coated-layer-forming solution includes a first stirring process of adding the resin to a solvent and mixing and stirring them; and a second stirring process of further adding the specific porous carbon to the solvent and stirring and mixing them.

As the solvent of the coating solution which is used for forming the coating layer containing the specific porous carbon, tetrahydrofuran, toluene, dichloromethane, and dichlorobenzene are preferable and tetrahydrofuran is more preferable from the viewpoint of solubility of the specific porous carbon. Methyl ethyl ketone, which is widely used as a solvent of a coating solution of a coating layer in the related art, is not preferable because the solubility of the specific porous carbon is low and thus the amount used for dissolving the specific porous carbon is large.

In addition, there may be used a method of preparing a carrier in which, instead of using a solvent, resin particles are attached onto the core and heated to be fused.

Developer for Developing Electrostatic Charge Image

The developer for developing an electrostatic charge image according to the exemplary embodiment (hereinafter, sometimes referred to as the developer according to the exemplary embodiment) is configured as a two-component developer for developing an electrostatic charge image which contains the carrier according to the exemplary embodiment and toner.

Hereinafter, the toner used for the developer according to the exemplary embodiment will be described.

Toner

The toner is not particularly limited, and well-known toners are used. As a representative example of the toner, there may be used a color toner containing a binder resin and a colorant and an infrared-ray-absorbing toner in which an infrared ray absorbent is used instead of the colorant. Optionally, in addition to the above-described components, a wax (release agent), magnetic particles, a charge-controlling agent, a viscosity adjuster, and other additives may be added.

As the binder resin, polyester resin is preferable, and polyester resin which contains an alkylene oxide adduct of bisphenol A as a component on the alcohol side is more preferable. In addition, polyester resin may be used alone or in combination with other resins. Examples of other resins include polyolefin resin, cyclic olefin resin, a copolymer of styrene and acrylic acid (or methacrylic acid), polyvinyl chloride, phenol resin, acrylic resin, methacrylic resin, polyvinyl acetate, silicone resin, modified polyester resin, polyurethane resin, polyamide resin, furan resin, epoxy resin, xylene resin, polyvinyl butyral resin, terpene resin, coumarone-indene resin, petroleum resin, and polyether polyol resin.

When flash fixing is performed, a toner containing polyester resin, which contains an alkylene oxide adduct of bisphenol A, as the binder resin is preferable from the viewpoint of suppressing an odor and the like.

The colorant of the toner which is used in the exemplary embodiment is not particularly limited, and examples thereof include Carbon Black, Aniline Blue, Calcoil Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengal, C.I. PIGMENT RED 48:1, C.I. PIGMENT RED 122, C.I. PIGMENT RED 57:1, C.I. PIGMENT YELLOW 97, C.I. PIGMENT YELLOW 12, C.I. PIGMENT BLUE 15:1, and PIGMENT BLUE 15:3.

Furthermore, the toner which is used in the exemplary embodiment may contain a charge-controlling agent, and examples of the charge-controlling agent include nigrosine, quaternary ammonium salt, an organometallic complex, and a chelate complex.

Furthermore, the toner which is used in the exemplary embodiment may contain a release agent, and examples of the release agent include ester wax; polyethylene; polypropylene or a compolymer of polyethylene and polypropylene; polyglycerine wax; microcrystalline wax; paraffin wax; carnauba wax; sasol wax; montan acid ester wax; deoxidized carnauba wax; unsaturated fatty acids such as palmitic acid, stearic acid, montanoic acid, brassidic acid, eleostearic acid, or parinaric acid, saturated alcohols such as stearic alcohol, aralkyl alcohol, behenyl alcohol, carnaubyl alcohol, ceryl alcohol, melissyl alcohol, or long-chain alkyl alcohol having a long-chain alkyl group; polyols such as sorbitol; fatty acid amides such as linoleic amide, oleic amide, or lauric amide; saturated fatty acid bisamides such as methylene-bis-stearic acid amide, ethylene-bis-capric acid amide, ethylene-bis-lauric acid amide, or hexamethylene-bis-stearic acid amide, unsaturated fatty acid amides such as ethylene-bis-oleic acid amide, hexamethylene-bis-oleic acid amide, N,N'-dioleyl adipic acid amide, or N,N'-dioleyl sebacic acid amide; aromatic bisamides such as m-xylene bis-stearic acid amide, N,N'-distearyl isophthalic acid amide; fatty acid metal salt (so-called, metal soap) such as calcium stearate, calcium laurate, zinc stearate, or magnesium stearate; waxes in which an aliphatic hydrocarbon wax is grafted using a vinyl monomer such as styrene and an acrylic acid; a partially esterified compound of fatty acid such as monoglyceride behenate and polyol; and a methyl ester compound having a hydroxy group obtained by adding a hydrogen atom to a vegetable oil.

The preparation method of the toner is not particularly limited. For example, a kneading and pulverizing method and a wet preparation method which are used in general may be used. Examples of the wet preparation method include a suspension polymerization method, an emulsion polymerization method, an emulsion polymerization aggregation method, a soap-free emulsion polymerization method, a non-aqueous dispersion polymerization method, an in-situ polymerization method, an interfacial polymerization, an emulsification dispersion granulation method, and an aggregation coalescence method.

In order to prepare the toner using the kneading and pulverizing method, the binder resin and, optionally, the colorant, and other additives are sufficiently mixed using a mixer such as a Henschel mixer or a ball mill and melted and kneaded using a heat kneading machine such as a heating roll, a kneader, or an extruder to dissolve the resin and the like in each other. Then, an infrared ray absorbent, an antioxidant, and the like are dispersed or dissolved, followed by cooling solidification, pulverizing, and classification. As a result, the toner is obtained.

It is preferable that the average particle size of toner particles be from 2 μm to 10 μm.

External Additive of Toner

Examples of an external additive added to the toner include silica, titanium oxide, cerium oxide, barium titanate, fluoride particles, and acrylic particles. These external additives may be used alone or in combination. As silica, commercially available products such as TG-820 (manufactured by Cabot Corporation), HVK-2150 (manufactured by Clariant (Japan) K.K.) may be used.

In addition, it is preferable that the volume average particle size of the external additive be from 20 nm to 1 μm.

The developer according to exemplary embodiment is obtained by mixing the toner and the carrier using, for example, a Nautor mixer, and the content of the toner is preferably from 1% by weight to 10% by weight and preferably 2% by weight and 6% by weight with respect to the total amount of the carrier and the toner.

Process Cartridge, Image Forming Apparatus, and Image Forming Method

Next, the image forming apparatus according to the exemplary embodiment which uses the developer according to the exemplary embodiment will be described.

The image forming apparatus according to the exemplary embodiment includes an image holding member; a charging unit that charges a surface of the image holding member with electricity; a latent image forming unit that forms an electrostatic latent image on the surface of the image holding member; a developing unit that forms a toner image by developing the electrostatic latent image, which is formed on the surface of the image holding member, using the developer for developing an electrostatic charge image according to the exemplary embodiment; and a transfer unit that transfers the formed toner image onto a transfer medium, wherein, when the toner image is formed, a transport speed of the transfer medium is from 1000 mm/sec to 2000 mm/sec.

The image forming apparatus according to the exemplary embodiment is not limited as long as it can form a fixed toner image on a recording medium using the developer according to the exemplary embodiment containing the carrier according to the exemplary embodiment. Specifically, the image forming apparatus includes a latent image holding member, a charging device that charges a surface of the latent image holding member with electricity, a latent image forming device that forms a latent image on the charged surface of the latent image holding member, a developing device that develops the latent image, which is formed on the surface of the latent image holding member, using the above-described toner of the developer according to the exemplary embodiment to obtain a toner image, and a transfer device that transfers the toner image, which is formed on the surface of the latent image holding member, onto a recording medium. Optionally, the image forming apparatus according to the exemplary embodiment may further include other devices such as a cleaning device that scrubs the latent image holding member with a cleaning member to clean a non-transferred residual component.

In the image forming apparatus, for example, a portion including the developing device may have a cartridge structure (process cartridge) which is detachable from the image forming apparatus main body. The process cartridge includes at least a developer holding member. Preferably, the process cartridge according to the exemplary embodiment which contains the developer according to the exemplary embodiment, is used.

When an electrophotographic photoreceptor is used as the latent image holding member, an image is formed in the following method. First, the surface of the electrophotographic photoreceptor is charged with electricity using, for example, a corotron charger or a contact charger and exposed to light to form a latent image (electrostatic charge image). Next, the surface of the electrophotographic photoreceptor and a developing roller, in which a developer layer is formed on the surface, are brought into contact each other or close to each other to attach the toner to the latent image. As a result, a toner image is formed on the electrophotographic photoreceptor. The formed toner image is transferred onto the surface of a recording medium such as paper by, for example, a corotron charger. Furthermore, the toner image which is transferred onto the surface of the recording medium is fixed by a fixing device. As a result, an image is formed on the recording medium.

It is preferable that the processing speed of the image forming apparatus according to the exemplary embodiment be equal to or higher than 1000 mm/sec. In this case, the processing speed represents a transport speed of a recording medium when an image is formed on the recording medium such as paper. More specifically, the processing speed of 1000 mm/sec or higher represents that images can be continuously formed on 50 sheets or more of paper per second when the length of the paper is, 20 mm for example. The processing speed (transport speed) of the transfer medium is more preferably from 1000 mm/sec to 2000 mm/sec.

As the electrophotographic photoreceptor, in general, inorganic photoreceptors such as amorphous silicon or selenium and organic photoreceptors, in which polysilane, phthalocyanine, or the like are used as a charge generating material or a charge transporting material, may be used. However, amorphous silicon photoreceptor is particularly preferable due to its long life.

In addition, the fixing device is not particularly limited as long as it can perform fixing through heat and pressure or light. When the toner according to the exemplary embodiment is used as a light fixing toner, a light fixing device (general-purpose flash fixing device; in the case of laser beam fixing, it is preferable that the wavelength of a laser beam be from 930 nm to 980 nm) is used. However, in the other cases, a heat roller fixing device, an oven fixing device, and the like are used. In the exemplary embodiment, light fixing is preferably performed from the viewpoint of high speed.

As the heat roller fixing device, in general, a heating roller type fixing device in which a pair of fixing rollers face each other and are urged against each other, is used. As the pair of fixing rollers, a heating roller and a pressure roller are provided to face each other and urged against each other, thereby forming a nip portion. The heating roller is obtained by sequentially forming an oil-and-heat-resistant elastic body layer (elastic layer) and a surface layer, which is formed of fluororesin and the like, in a hollow metal core having a heating lamp therein. The pressure roller is obtained by sequentially forming the oil-and-heat-resistant elastic body layer and the surface layer in a hollow metal core which optionally has a heating lamp therein. In the nip portion formed by the heating roller and the pressure roller, a recording medium on which an unfixed toner image is formed passes through this portion. As a result, the unfixed toner image is fixed.

As a light source used in the light fixing device, for example, there are a halogen lamp, a mercury lamp, a flash lamp, and an infrared laser, which are normally used. However, a flash lamp is most preferable from the viewpoint of energy saving because it can perform fixing instantaneously. The intensity of light emitted from the flash lamp is preferably from 1 J/cm$^2$ to 7 J/cm$^2$ and more preferably 2 J/cm$^2$ to 5 J/cm$^2$.

In this case, the intensity of light emitted from the flash lamp per unit area, that indicates the intensity of light emitted from a xenon lamp, is obtained using Expression (2) below.

$$S=((1/2)\times C\times V^2)/(u\times L)\times(n\times f) \quad \text{Expression (2)}$$

In Expression (2) above, n represents the number of lamps which emit light at one time, f represents a lamp frequency (Hz), V represents an input voltage (V), C represents a capacitance (F), u represents a process transport speed (cm/s), L represents an effective emission width of a flash lamp (normally, maximum width of paper; cm), and S represents a light intensity (J/cm$^2$).

As the method of light fixing, a delay method in which light is emitted from plural flash lamps at time intervals is preferable. In this delay method, plural flash lamps are arranged and emit light at time intervals of approximately 0.01 ms to 100 ms, thereby illuminating the same portion multiple times. As a result, light energy may be supplied to a toner image not at one time but at time intervals. Therefore, fixing conditions may be mild and thus fixability and void resistance may be secured at the same time.

In this case, when the flash lamps illuminate a toner with light multiple times, the light intensity emitted from the flash lamps indicates the sum of intensities of light which are respectively emitted once on the unit area from the flash lamps.

In the exemplary embodiment, the number of flash lamps is preferably from 1 to 20 and more preferably from 2 to 10. In addition, the respective time intervals between plural flash lamps are preferably from 0.1 msec to 20 msec and more preferably from 1 msec to 3 msec.

Furthermore, the intensity of light which is emitted once from a single flash lamp is preferably from 0.1 J/cm$^2$ to 2.5 J/cm$^2$ and more preferably from 0.4 J/cm$^2$ to 2.0 J/cm$^2$.

Hereinafter, as an example of the image forming apparatus according to the exemplary embodiment, an image forming apparatus including a light fixing device will be described with reference to the drawing.

Figure 2:
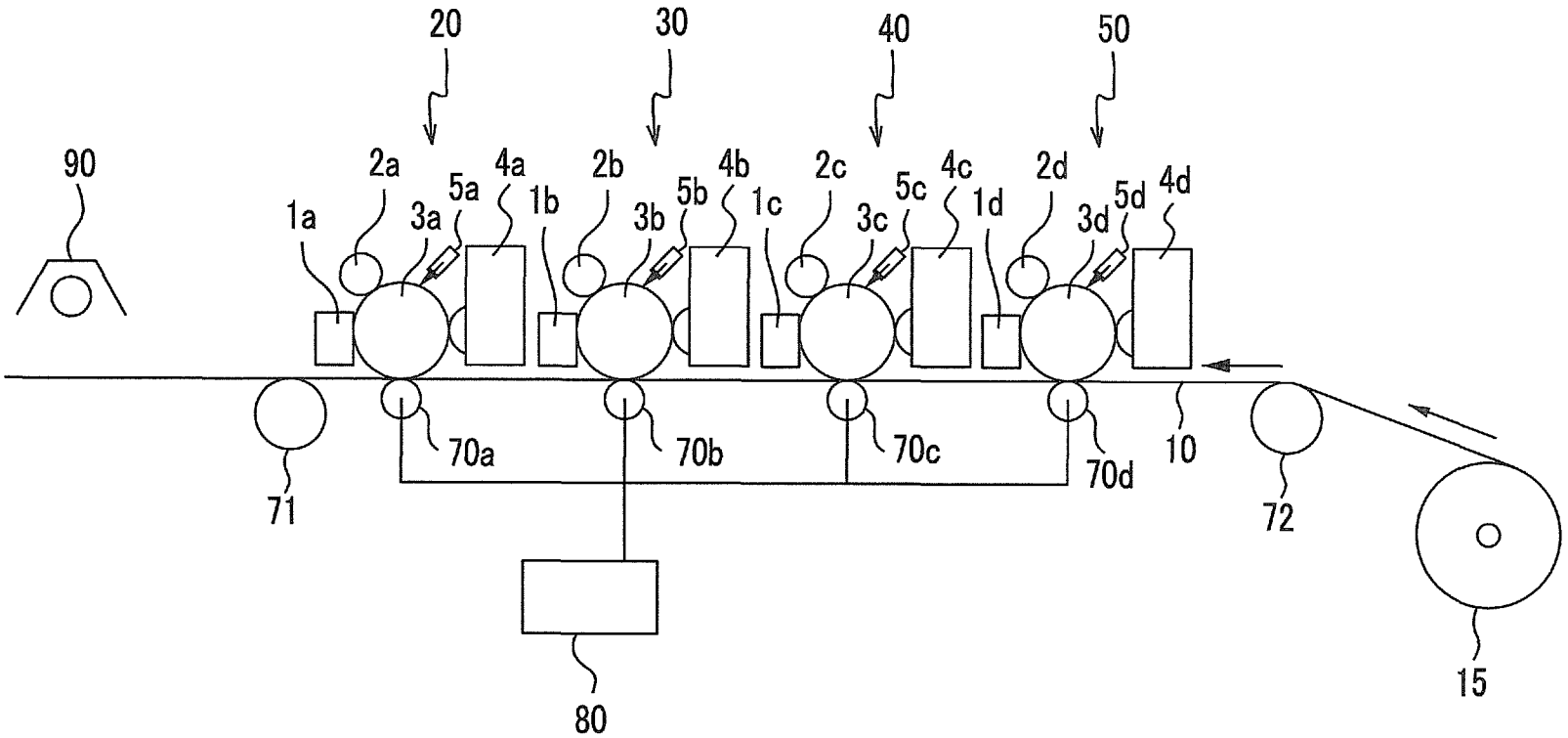
FIG. 2 is a schematic configuration diagram illustrating an example of an image forming apparatus according to an exemplary embodiment of the invention.

FIG. 2 is a schematic diagram illustrating an example of the image forming apparatus including the light fixing device. In the image forming apparatus shown in FIG. 2, toner images are formed using toners including three color (cyan, magenta, and yellow) toners and black toner. In addition, the processing speed of this image forming apparatus is set to be equal to or higher than 1000 mm/sec.

In FIG. 2, reference numerals 1*a*, 1*b*, 1*c*, and 1*d* represent cleaning devices, reference numerals 2*a*, 2*b*, 2*c*, and 2*d* represent charging devices, reference numerals 5*a*, 5*b*, 5*c*, and 5*d* represent exposure devices, reference numerals 3*a*, 3*b*, 3*c*, and 3*d* represent photoreceptors (latent image holding members), reference numerals 4*a*, 4*b*, 4*c*, and 4*d* represent developing devices, reference numeral 10 represents recording paper (recording medium) which is transported from a roll medium 15 in a direction indicated by arrows, reference numeral 20 represents a cyan developing unit, reference numeral 30 represents a magenta developing unit, reference numeral 40 represents a yellow developing unit, reference numeral 50 represents a black developing unit, reference numerals 70*a* to 70*d* represent transfer rollers (transfer devices), reference numerals 71 and 72 represent feed rollers, reference numeral 80 represents a transfer voltage supplying unit, and reference numeral 90 represents the light fixing device (fixing device).

The image forming apparatus shown in FIG. 2 includes the developing units (toner image forming units) 20, 30, 40, and 50 for the respective colors that respectively include the charging device, the exposure device, the photoreceptor, and the developing device; the feed rollers 71 and 72 that contact recording paper 10 and transport the recording paper 10; the transfer rollers 70*a*, 70*b*, 70*c*, and 70*d* that are disposed opposite the respective photoreceptors of the respective developing units so as to be pressed against the photoreceptors and to contact the photoreceptors through the recording paper 10; the transfer voltage supplying unit 80 that supplies voltage to the four transfer rollers; and the light fixing device (fixing device) 90 that emits light onto a side, which contacts the photoreceptors, of the recording paper 10 which passes through nip portions formed by the photoreceptors and the transfer rollers in the arrow direction of the drawing.

In the cyan developing unit 20, the charging device 2*a*, the exposure device 5*a*, and the developing device 4*a* are arranged clockwise around the photoreceptor 3*a*. In addition, the transfer roller 70*a* is disposed opposite the photoreceptor 3*a* so as to contact a surface portion of the photoreceptor 3*a*, which ranges clockwise from where the developing device 4*a* is disposed to where the charging device 1*a* is disposed, through the recording paper 10. The other color developing units have the same configuration as above. In the image forming apparatus according to the exemplary embodiment, the developing device 4*a* of the cyan developing unit 20 contains a developer containing cyan toner and the respective developing devices of the other developing units contain developers containing light fixing toners corresponding to the respective colors.

The image forming method according to the exemplary embodiment includes charging a surface of an image holding member with electricity; forming an electrostatic latent image on the surface of the image holding member; forming a toner image by developing the electrostatic latent image, which is formed on the surface of the image holding member, using the developer for developing an electrostatic charge image according to the exemplary embodiment; and transferring the formed toner image onto a transfer medium, wherein, when the toner image is formed, the transport speed of the transfer medium is from 1000 mm/sec to 2000 mm/sec.

Next, image formation using this image forming apparatus will be described. First, in the black developing unit 50, the surface of the photoreceptor 3*d* is charged with electricity by the charging device 1*d* while the photoreceptor 3*d* is rotated clockwise. Next, the charged surface of the photoreceptor 3*d* is exposed to light by the exposure device 5*d*. As a result, a latent image is formed on the surface of the photoreceptor 3*d* so as to correspond to black color components of an original image to be copied. Furthermore, the black toner, which is included in the developing device 4*d*, is applied to the latent image to be developed. As a result, a black toner image is formed. This process is performed in the same manner in the yellow developing unit 40, the magenta developing unit 30, and the cyan developing unit 20. As a result, toner images of the respective colors are formed on the surfaces of the photoreceptors of the respective developing units.

The respective color toner images, which are formed on the surfaces of the photoreceptors, are sequentially transferred onto the recording paper 10, which is transported in the arrow direction, by the action of transfer potentials of the transfer rollers 70*a*, 70*b*, 70*c*, and 70*d*; the transferred toner images are layered on the surface of the recording paper 10 so as to correspond to original image information; and a layered toner image, which has layers in order of cyan, magenta, and yellow from the uppermost layer, are formed.

Next, the toner image layers on the recording paper 10 are transported to the light fixing device 90 and flashed with light from the light fixing device 90 to be melted. As a result, a light-fixed color image is formed on the recording medium 10.

Then, the color image is treated with a post-processing device (post-procession unit) (not shown) such as a cutter or a sealing device and then used as images corresponding to various applications.

EXAMPLES

Hereinafter, the invention will be described in further detail with reference to Examples, but the invention is not limited to Examples below. Hereinafter, "part" and "%" represent "part by weight" and "%, by weight" unless specified otherwise.

Comparative Example 1

Preparation of Carrier 1

(1) Preparation of Core

Ferrite (EF-35B: trade name, manufactured by Powdertech Co., Ltd., weight average particle size: 35 μm) is used as a core. In ferrite particles as the core, the saturation magnetization at an applied magnetic field of 10 kOe is 65 $A \cdot m^2/kg$.

100 parts of ferrite particles (manufactured by Powdertech Co., Ltd.; weight average particle size: 35 μm), parts of KYNAR 7201 (manufactured by Pennwalt Ltd., vinylidene fluoride-tetrafluoroethylene copolymer), and 0.4 part of Carbon Black (Ketjen Black EC-600JD, manufactured by Lion Corporation, BET specific surface area: 1270 $m^2/g$) are mixed for 5 minutes in a 1 L small kneader. The temperature of a heating medium is set to 200° C. and the mixture is stirred and kneaded for 40 minutes. Then, a heater is turned off and the resultant is cooled under stirring for 50 minutes. Next, screening is performed using a 75 μm sieve. As a result, Carrier 1 is obtained.

Components of Carrier 1 are shown in Table 1.

Preparation of Toner

Toner compositions that include 83 parts of polyester resin (FP-118, manufactured by Kao Corporation) as a binder resin which has a proplylene oxide adduct of bisphenol A as a base material, 15 parts of NIPEX 35 (manufactured by Evonik Degussa Japan Co., Ltd.) as a pigment, 1 part of quaternary ammonium salt (PSY, manufactured by ClarianL (Japan) K.K.), and 1 part of polyethylene wax (NL900, manufactured by Mitsui Chemicals), are respectively put into Henschel mixers, preliminarily mixed, melted and kneaded in a temperature range of 100° C. to 110° C. using an extruder (PCM-30, manufactured by Ikegai Corporation) at 250 rpm, coarsely pulverized using a hammer mill, finely pulverized using a jet mill, and classified using an air classifier. As a result, yellow toner base particles are obtained.

1.5 parts of silica (TG-820F, manufactured by Cabot Corporation) is externally added to these toner base particles using a high-speed stirring device (Henschel mixer). As a result, a toner having particles with a volume average particle size of 3.8 μm is obtained.

Preparation of Developer 1

94 parts of Carrier 1 and 5 parts of the toner above are mixed in a ball mill. As a result, Developer 1 is obtained.

Evaluation Test

Images, which are formed using Developer 1 obtained above, are evaluated using an actual apparatus. As an evaluation apparatus, a Fuji Xerox 490/980 Continuous Feed Printer-modified machine (manufactured by Fuji Xerox Co., Ltd.; the schematic configuration is the same as that of FIG. 2) which is provided with a laser lamp as a light fixing device is used. The processing speed (transport speed) is 1500 mm/sec.

Images having a coverage rate of 0.5% are continuously printed on plain paper (NPI paper, manufactured by Kobayashi Create Co., Ltd.) as a recording medium by the image forming apparatus under the conditions of 10° C. and 10% RH and evaluated in the following method. The obtained results are shown in Table 2.

In the test, at the initial stage, 1000 solid image samples having a size of 1 inch are printed, 2,000,000 images having a coverage rate of 0.5% are continuously printed, and the same solid images as that of the initial stage are printed. Then, the solid images at the initial stage and the solid images, which are printed after 2,000,000 images are printed, are evaluated.

Measurement of Optical Density

The densities of the obtained 1-square-inch images are evaluated as follows. Optical densities (OD) are measured using X-Rite 938.

Measurement of Toner Charge Amount

A developer is withdrawn from the actual apparatus and a toner charge amount is measured using a blow-off charge amount measurement device (manufactured by Toshiba Chemical Corporation). In this case, charge amount is obtained as the maximum value in the measurement time of 20 seconds under conditions of the blow-off charge amount measurement device in which the blow pressure is 1 $kg/cm^2$, the wire used is 300 m SUS mesh, and the measurement time is 20 seconds.

Measurement of Electrical Resistance of Carrier

A carrier of a developer is extracted from a developer unit by suctioning and withdrawing a toner through the 16 μm mesh and the electrical resistance of the carrier is measured.

Figure 3:
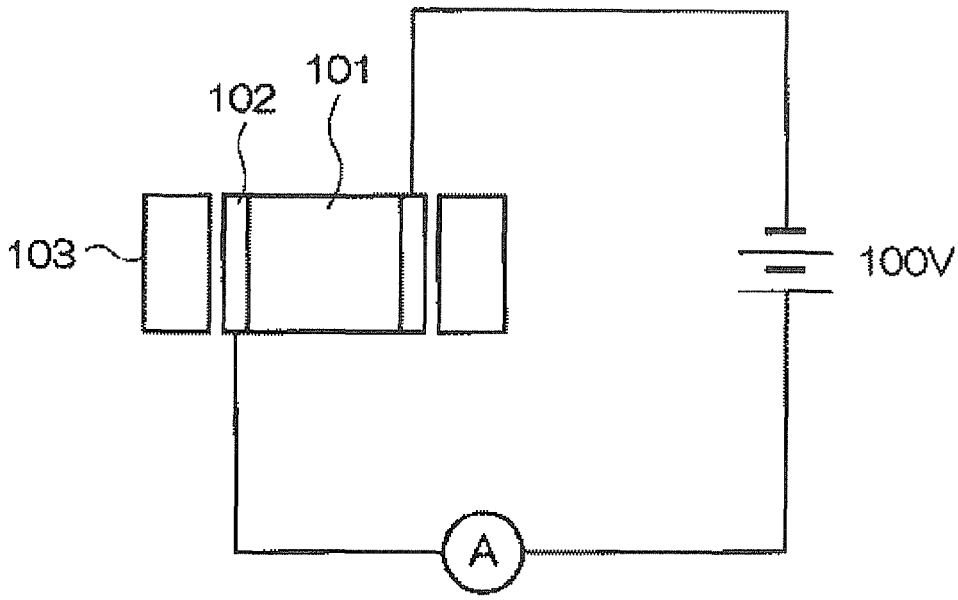
FIG. 3 is a diagram illustrating measurement equipment for measuring electrical resistance of a carrier.

FIG. 3 shows measurement equipment for measuring electrical resistance of a carrier. Reference numerals in FIG. 3 represent the following components, respectively.

101: Sample Cell (10×10×15 mm, magnetic field strength of central portion: 3400 e)

102: Electrode

103: Magnet (7×15×20 mm, material: ferrite (surface magnetic flux density: 950 Gauss)

As the measurement equipment for measuring electrical resistance of a carrier, specifically, a digital ultra-high insulation-resistance tester R8340A (manufactured by Advantest Corporation) is used.

The equipment has a configuration shown in FIG. 3 in which the sample cell 101 is disposed at the center, the electrodes 102 are disposed at both ends of the sample cell 101, and the magnets 103 are disposed at the sides of the electrodes 102. The insulation-resistance tester is connected to the electrode 102 as shown in the drawing.

A specific measurement method using the above equipment is that 1077 $cm^3$ of the carrier is put into the sample cell 101 of the equipment, a voltage of 100 V is applied thereto using the digital ultra-high resistance meter, and a value measured after 15 seconds is obtained as a value of electrical resistance.

Measurement of Abrasion Residual Amount of Coating Layer

The amount of carbon, which is generated when a carrier coating material is combusted, is measured using a carbon combustion analyzer (EMIA-110, manufactured by Horiba Ltd.). In addition, the abrasion residual amount of the coating layer is measured using Expression (1), wherein $C_0$ represents the amount of carbon in the initial product of a carrier; and Ci represents the amount of carbon in a carrier after 2,000,000 images are printed and attached toner particles are removed by washing with acetone.

$$\text{Abrasion Residual Amount of Coating Layer} = Ci/C_0 \times 100(\%) \quad (1)$$

Examples 1 to 9

Carriers 2 to 10 are prepared in the same preparation method as that of Carrier 1 according to Comparative Example 1, except that components used are changed as shown in Table 1. The carriers thus obtained are evaluated in the same method as that of Comparative Example 1. The obtained results are shown in Table 2.

Example 10

Preparation of Carrier 11

Preparation of Coating-Layer-Forming Solution 12 parts of trifluoropropyltrimethoxysilane (KBM-7103: trade name, manufactured by Shin-Etsu Chemical Co., Ltd.) and 3 parts of tetraethoxysilane (KBE-04: trade name, manufactured by Shin-Etsu Chemical Co., Ltd.) are mixed and cooled to 20° C.

Next, 2 parts of 0.25 N acetic acid are added thereto and the resultant is left to stand overnight in a temperature range of 20° C. to 30° C. to be hydrolyzed. 35 parts of isopropyl alcohol and 100 parts of tetrahydrofuran are added to this solution. As a result, a silicone resin solution having a solid content of 10% is prepared.

Furthermore, 400 parts of this silicone resin solution (in terms of solid content), 40 parts of Carbon Black (Ketjen Black EC-600JD: trade name, manufactured by Lion Corporation, BET specific surface area: 1270 $m^2/g$), and 50 parts of Porous carbon 1 (which will be described below) are mixed to obtain a coating-layer-forming solution.

Coating 49 parts of coating-layer-forming solution (in terms of solid content) is put into a fluid bed coating device (SPIR-A-FLOW, manufactured by FREUND-VECTOR CORPORATION) with respect to 1000 parts of ferrite particles obtained above and coating is performed for 30 minutes. Then, drying is performed at 150° C. As a result, Carrier 11 is obtained. Carrier 11 is evaluated in the same method as that of Comparative Example 1, except that Carrier 11 is used instead of Carrier 1. The obtained results are shown in Table 2.

Example 11

Preparation of Coating-Layer-Forming-Solution 12 parts of trifluoropropyltrimethoxysilane (KBM-7103: trade name, manufactured by Shin-Etsu Chemical Co., Ltd.) and 3 parts of tetraethoxysilane (KBE-04: trade name, manufactured by Shin-Etsu Chemical Co., Ltd.) are mixed and cooled to 20° C.

Next, 2 parts of 0.25 N acetic acid are added thereto and the resultant is left to stand overnight in a temperature range of 20° C. to 30° C. to be hydrolyzed. 35 parts of isopropyl alcohol and 100 parts of tetrahydrofuran are added to this solution. As a result, a silicone resin solution having a solid content of 10% is prepared.

Furthermore, 400 parts of this silicone resin solution (in terms of solid content) and 50 parts of Porous carbon 1 (which will be described below) are mixed to obtain Coating-layer-forming solution 1.

In addition, 12 parts of trifluoropropyltrimethoxysilane (KBM-7103: trade name, manufactured by Shin-Etsu Chemical Co., Ltd.) and 3 parts of tetraethoxysilane (KBE-04: trade name, manufactured by Shin-Etsu Chemical Co., Ltd.) are mixed and cooled to 20° C.

Next, 2 parts of 0.25 N acetic acid are added thereto and the resultant is left to stand overnight in a temperature range of 20° C. to 30° C. to be hydrolyzed. 35 parts of isopropyl alcohol and 100 parts of tetrahydrofuran are added to this solution. As a result, a silicone resin solution having a solid content of 10% is prepared.

Furthermore, 400 parts of this silicone resin solution (in terms of solid content) and 40 parts of Carbon Black (Ketjen Black EC-600JD: trade name, manufactured by Lion Corporation, BET specific surface area: 1270 $m^2/g$) are mixed to obtain Coating-layer-forming solution 2.

Coating 19 parts of Coating-layer-forming solution 2 (in terms of solid content) is put into a fluid bed coating device (SPIR-A-FLOW, manufactured by FREUND-VECTOR CORPORATION) with respect to 1000 parts of ferrite particles obtained above and coating is performed for 30 minutes. Then, drying is performed at 150° C. Furthermore, 30 parts of Coating-layer-forming solution 1 (in terms of solid content) is put thereinto and coating is performed for 30 minutes. Then, drying is performed at 150° C. As a result, Carrier 12 is obtained. Carrier 12 is evaluated in the same method as that of Comparative Example 1, except that Carrier 12 is used instead of Carrier 1. The obtained results are shown in Table 2.

Example 12

Example 12 is evaluated in the same method as that of Example 9, except that the processing speed (transport speed) is 1000 mm/sec. The obtained results are shown in Table 2.

TABLE 1

| | | Part By Weight Ferrite Particles | Single-Layer Coating Layer (Part By Weight) Vinylidene Fluoride-Tetrafluoro ethylene Copolymer | Fluorine-Modified Silicone Resin | Carbon Black | Porous Carbon 1 | Porous Carbon 2 | Porous Carbon 3 | Porous Carbon 4 |
|---|---|---|---|---|---|---|---|---|---|
| Comparative Example 1 | Carrier 1 | 100 | 4 | | 0.4 | 0 | 0 | 0 | 0 |
| Example 1 | Carrier 2 | 100 | 4 | | 0.4 | 0.04 | 0 | 0 | 0 |
| Example 2 | Carrier 3 | 100 | 4 | | 0.4 | 0.2 | 0 | 0 | 0 |
| Example 3 | Carrier 4 | 100 | 4 | | 0.4 | 0.5 | 0 | 0 | 0 |
| Example 4 | Carrier 5 | 100 | 4 | | 0.4 | 2 | 0 | 0 | 0 |

TABLE 1-continued

| | | Part By Weight Ferrite Particles | Single-Layer Coating Layer (Part By Weight) Vinylidene Fluoride-Tetrafluoro ethylene Copolymer | Fluorine-Modified Silicone Resin | Carbon Black | Porous Carbon 1 | Porous Carbon 2 | Porous Carbon 3 | Porous Carbon 4 |
|---|---|---|---|---|---|---|---|---|---|
| Example 5 | Carrier 6 | 100 | 4 | | 0.4 | 5 | 0 | 0 | 0 |
| Example 6 | Carrier 7 | 100 | 4 | | 0.4 | 0 | 0.5 | 0 | 0 |
| Example 7 | Carrier 8 | 100 | 4 | | 0.4 | 0 | 0 | 0.5 | 0 |
| Example 8 | Carrier 9 | 100 | 4 | | 0.4 | 0 | 0 | 0 | 0.5 |
| Example 9 | Carrier 10 | 100 | 4 | | 0 | 0.5 | 0 | 0 | 0 |
| Example 10 | Carrier 11 | 100 | | 4 | 0.4 | 0.5 | 0 | 0 | 0 |

TABLE 2

| | | Optical Density | | Electrical Resistance (Ω) | | Charge (μC/g) | | Remaining Amount of Coating Layer | | |
|---|---|---|---|---|---|---|---|---|---|---|
| | | Initial Stage | After 2,000,000 images are printed | Initial Stage | After 2,000,000 images are printed | Initial Stage | After 2,000,000 images are printed | Initial Stage | After 2,000,000 images are printed | Remark |
| Comparative Example 1 | Carrier 1 | 1.41 | 0.9 | $5.5 \times 10^5$ | $5.1 \times 10^{10}$ | 25 | 24 | 100% | 55% | Low Density Blur |
| Example 1 | Carrier 2 | 1.41 | 1.35 | $5.5 \times 10^5$ | $4.5 \times 10^6$ | 24 | 26 | 100% | 80% | |
| Example 2 | Carrier 3 | 1.41 | 1.38 | $5.4 \times 10^5$ | $2.9 \times 10^6$ | 23 | 24 | 100% | 85% | |
| Example 3 | Carrier 4 | 1.41 | 1.44 | $5.3 \times 10^5$ | $3.6 \times 10^5$ | 25 | 26 | 100% | 90% | |
| Example 4 | Carrier 5 | 1.41 | 1.35 | $5.2 \times 10^5$ | $5.5 \times 10^6$ | 25 | 24 | 100% | 85% | |
| Example 5 | Carrier 6 | 1.41 | 1.32 | $5.0 \times 10^5$ | $4.2 \times 10^7$ | 24 | 26 | 100% | 78% | |
| Example 6 | Carrier 7 | 1.41 | 1.36 | $5.5 \times 10^5$ | $2.6 \times 10^6$ | 23 | 24 | 100% | 84% | |
| Example 7 | Carrier 8 | 1.41 | 1.32 | $5.6 \times 10^5$ | $7.5 \times 10^7$ | 25 | 26 | 100% | 77% | |
| Example 8 | Carrier 9 | 1.41 | 1.40 | $5.4 \times 10^5$ | $4.8 \times 10^5$ | 25 | 24 | 100% | 89% | |
| Example 9 | Carrier 10 | 1.30 | 1.30 | $5.2 \times 10^7$ | $6.6 \times 10^7$ | 24 | 26 | 100% | 89% | Density is slightly less from initial stage |
| Example 10 | Carrier 11 | 1.41 | 1.40 | $5.2 \times 10^5$ | $9.6 \times 10^5$ | 23 | 24 | 100% | 85% | |
| Example 11 | Carrier 12 | 1.52 | 1.52 | $1.2 \times 10^5$ | $1.3 \times 10^5$ | 25 | 26 | 100% | 96% | |
| Example 12 | Carrier 9 | 1.41 | 1.40 | $5.2 \times 10^5$ | $9.6 \times 10^5$ | 25 | 24 | 100% | 95% | |

In Table 1, the following materials are used as Porous carbons 1 to 4.

Porous Carbon 1: RB Ceramics ("RBC powder of 10 μm or less", pulverized product, manufactured by Sanwa Yushi Co., Ltd., volume average particle size: 0.5 μm, BET specific surface area: 5 $m^2/g$)

Porous Carbon 2: RB Ceramics ("RBC powder of 10 μm or less", pulverized product, manufactured by Sanwa Yushi Co., Ltd., volume average particle size: 1 μm, BET specific surface area: 4 $m^2/g$)

Porous Carbon 3: RB Ceramics ("RBC powder of 10 μm or less", pulverized product, manufactured by Sanwa Yushi Co., Ltd., volume average particle size: 2 μm, BET specific surface area: 1 $m^2/g$)

Porous Carbon 4: PHYTOPOROUS SH-0905 (pulverized product, manufactured by The Nisshin OilliO Group, Ltd., volume average particle size: 0.5 μm, BET specific surface area: 4 $m^2/g$)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A carrier for developing an electrostatic charge image comprising:

a core containing a magnetic material; and a coating layer, wherein the coating layer contains porous carbon having a volume average particle size of from 0.5 μm to 2 μm and a BET specific surface area of from 1 $m^2/g$ to 5 $m^2/g$, and a resin.

2. The carrier for developing an electrostatic charge image according to claim 1, wherein the resin is obtained by polymerizing vinylidene fluoride.

3. The carrier for developing an electrostatic charge image according to claim 1, wherein the coating layer is a single layer, and the coating layer further contains a conductive material.

4. The carrier for developing an electrostatic charge image according to claim 3, wherein the conductive material is carbon black.

5. The carrier for developing an electrostatic charge image according to claim 1, wherein the BET specific surface area of the porous carbon is from 2 $m^2/g$ to 4 $m^2/g$.

6. The carrier for developing an electrostatic charge image according to claim 1, wherein an amount of the porous carbon is from 0.05 part by weight to 5 parts by weight with respect to 100 parts by weight of the core.

7. The carrier for developing an electrostatic charge image according to claim 3, wherein a weight ratio of the porous carbon to the conductive material is from 1:0.1 to 1:5.

8. The carrier for developing an electrostatic charge image according to claim 1, wherein the coating layer is multiple layers of a first coating layer and a second coating layer, the first coating layer which is provided on the side of the core contains the resin and a conductive material, the second coating layer which is provided as the outermost layer contains the resin and the porous carbon, a content of the porous carbon in the second coating layer is greater than that in the first coating layer, and a content of the conductive material in the first coating layer is greater than that in the second coating layer.

9. The carrier for developing an electrostatic charge image according to claim 8, wherein an amount of the porous carbon in the second coating layer is from 0.05 part by weight to 5 parts by weight with respect to 100 parts by weight of the core.

10. A developer for developing an electrostatic charge image comprising:

the carrier for developing an electrostatic charge image according to claim 1; and a toner.

11. A developer for developing an electrostatic charge image comprising:

the carrier for developing an electrostatic charge image according to claim 8; and a toner.

12. The developer for developing an electrostatic charge image according to claim 10, wherein the coating layer of the carrier for developing an electrostatic charge image is a single layer, and the coating layer further includes a conductive material.

13. An image forming method comprising:

charging a surface of an image holding member with electricity;

forming an electrostatic latent image on the surface of the image holding member;

forming a toner image by developing the electrostatic latent image, which is formed on the surface of the image holding member, using the developer for developing an electrostatic charge image according to claim 10; and transferring the formed toner image onto a transfer medium, wherein, when the toner image is formed, a transport speed of the transfer medium is from 1000 mm/sec to 2000 mm/sec.

14. The image forming method according to claim 13, wherein the coating layer of the carrier for developing an electrostatic charge image is a single layer, and the coating layer further includes a conductive material.

15. The carrier for developing an electrostatic charge image according to claim 1, wherein the porous carbon contained in the coating layer has a volume average particle size of from 1.0 μm to 2 μm.

* * * * *